US005205948A

United States Patent [19]

Cardis

[11] Patent Number: 5,205,948

[45] Date of Patent: Apr. 27, 1993

[54] SULFURIZED OLEFIN-GLYCEROL MONOOLEATE ADDUCTS AND LUBRICANT COMPOSITIONS CONTAINING SAME

[75] Inventor: Angeline B. Cardis, Florence, N.J.

[73] Assignee: Mobil Oil Corp., Fairfax, Va.

[21] Appl. No.: 521,866

[22] Filed: May 11, 1990

Related U.S. Application Data

[63] Continuation-in-part of Ser. No. 227,949, Aug. 3, 1988, Pat. No. 4,929,253.

[51] Int. Cl.[5] ..... C10M 135/02

[52] U.S. Cl. ..... 252/48.6; 252/48.2

[58] Field of Search ..... 252/48.2, 48.6

[56] References Cited

U.S. PATENT DOCUMENTS

| | | | |
|---|---|---|---|
| 3,953,347 | 4/1976 | Habiby | 252/48.6 |
| 4,147,640 | 4/1979 | Jayne et al. | 252/45 |
| 4,344,854 | 8/1982 | Davis et al. | 252/48.6 |
| 4,380,499 | 4/1983 | Kammann, Jr. et al. | 252/48.6 |
| 4,487,705 | 12/1984 | Recchuite | 252/46.6 |
| 4,957,651 | 9/1990 | Schwind | 252/48.2 |
| 4,959,168 | 9/1990 | Schroeck | 252/48.6 |

FOREIGN PATENT DOCUMENTS 2842138 9/1978 Fed. Rep. of Germany .

*Primary Examiner*—Prince Willis, Jr.
*Assistant Examiner*—James Silbermann
*Attorney, Agent, or Firm*—Alexander J. McKillop; Malcolm D. Keen; Howard M. Flournoy

[57] ABSTRACT

Sulfurized olefins, particularly sulfurized isobutylene, are reacted with glycerol monooleate. The resulting product is useful as an additive for lube oil compositions.

14 Claims, No Drawings

SULFURIZED OLEFIN-GLYCEROL MONOOLEATE ADDUCTS AND LUBRICANT COMPOSITIONS CONTAINING SAME

RELATED APPLICATIONS

This application is a continuation-in-part of Ser. No. 227,949, filed Aug. 3, 1988, now U.S. Pat. No. 4,929,253

BACKGROUND OF THE INVENTION

1. Field of the Invention

The invention relates to novel compounds, particularly to those comprising reaction products of glycerol monooleate and selected sulfurized olefins and to lubricant compositions containing same.

2. Discussion of the Prior Art

Organic sulfur compounds have been known as additives for lubricating oils. They are generally used to provide extreme pressure properties to lubricants, especially under high-speed shock conditions. For example, sulfurized olefins are a known class of such organic sulfur compounds. Their utility and methods of preparation are disclosed in U.S. Pat. Nos. 3,471,404, 3,697,499 and 3,703,504.

Sulfurized olefins are commonly added to lubricants to improve extreme pressure properties. Sulfurized unsaturated fatty acids and esters of such fatty acid esters have also been used as in, e.g., U.S. Pat. No. 3,953,347. Many processes for the preparation of such products are known, some of which are two-stage processes, as U.S. Pat. No. 4,147,640.

Some sulfurized olefins prepared by the reaction of one or more olefins with elemental sulfur provide low-cost additives for improving the load carrying, extreme pressure performance of lubricating oils and greases. These highly sulfurized materials may, however, impart a high coefficient of friction to lubricants, rendering them unsuitable for certain lubricant applications. A primary purpose of this invention is to provide a means of rendering these lower cost sulfurized olefins suitable for use in lubricant formulations.

SUMMARY OF THE INVENTION

The invention comprises in one aspect the reaction product of a sulfurized olefin or mixture of sulfurized olefins of a special type and glycerol monooleate. In another aspect this invention comprises the lubricant composition made by combining the additive of this invention with a suitable lubricating oil or grease.

DESCRIPTION OF THE INVENTION

The sulfurized olefin preferably is prepared by reacting a hydrocarbon olefin having a single double bond and having from about 2 to about 8 carbon atoms per molecule with elemental or free sulfur. In the formation of organic sulfides according to the present invention a wide variety of olefinic substances can be charged to the sulfurization reaction including hydrocarbon olefins having a single double bond with terminal or internal double bonds and containing from about 2 to 8 or more carbon atoms per molecule in either straight, branched chain or cyclic compounds, and these may be exemplified by ethylene, propylene, butene-1, cis and trans butene-2, isobutylene, diisobutylene, tri-isobutylene, the pentenes, cyclopentene, the hexenes, cyclohexene, the octenes, decene-1, etc. In general, $C_3$ to $C_8$ olefins or mixtures thereof are preferable for preparing sulfurized products for use as extreme pressure additives as the combined sulfur content of the product decreases with increasing carbon content yet its miscibility with oil is lower for propylene and ethylene derivatives.

In some embodiments of the invention, isobutylene is particularly preferred as the sole olefinic reactant, but it may be employed, desirably in major proportion, in mixtures containing one or more other olefins; moreover, the charge may contain substantial proportions of saturated aliphatic hydrocarbons as exemplified by methane, ethane, propane, butanes, pentanes, etc. Such alkanes are preferably present in minor proportion in most instances to avoid unnecessary dilution of the reaction, since they neither react nor remain in the products but are expelled in the off-gases or by subsequent distillation. However, mixed charges can substantially improve the economics of the present process since such streams are of lower value than a stream of relatively pure isobutylene.

Volatile olefins are often readily available in liquid form, and it is usually desirable to charge olefinic liquids which are vaporized by the heat of reaction, as such evaporation provides a substantial cooling effect that permits the flow of water for cooling the reactor to be reduced considerably for greater economy.

The other reactant in the first stage is sulfur in a free or elemental state. The molar ratio of sulfur to olefin may range from about 1.7:1 up to 2.3:1 or more. In the case of sulfur and isobutylene the optimum ratio appears to be between about 1.9:1 and 2.1:1.

The preferred range of reaction temperatures is from about 140° C. to 180° C. and a temperature of about 160° C. appears to be the optimum. The reaction pressure is allowed to seek its own level, and may be illustrated by pressures ranging from about 300 to 900 pounds psig depending upon the reaction temperature and the volatility of the olefinic material. The reaction is carried out in the absence of added hydrogen sulfide.

The aforedescribed sulfurized olefin is then reacted with glycerol monooleate in a weight ratio of glycerol monooleate to sulfurized olefin of between 1 part and 20 parts of glycerol monooleate to 100 parts of sulfurized olefin. The reaction is carried out at a temperature of 70° to 120° C., at atmospheric pressure for a period of 0.5 to 3 hours. Commercially availably grades of glycerol monooleate ordinarily will also contain some glycerol dioleate but this does not affect the reaction adversely.

The lubricant compositions hereof may comprise any oleaginous materials that require lubricative properties under extreme pressure conditions and require protection against excessive wear under operating conditions, but normally exhibit insufficient frictional properties. Especially suitable for use with the additives of this invention are liquid hydrocarbon oils of lubricating viscosity. Lubricant oils, improved in accordance with the present invention, may be of any suitable lubricating viscosity. In general, the lubricant compositions may comprise any mineral or synthetic oil of lubricating viscosity or mixtures thereof. The additives of this invention are especially useful in greases and in automotive fluids such as brake fluids and power brake fluids, transmission fluids, power steering fluids, various hydraulic fluids and gear oils.

In instances where synthetic oils are desired in preference to refined petroleum or mineral oil they may be employed alone or in combination with a mineral oil.

They may also be used as the vehicle or base of grease compositions. Typical synthetic lubricants include polyisobutylene, polybutenes, hydrogenated polydecenes, polypropylene glycol, polyethylene glycol, trimethylol propane esters, neopentyl and pentaerythritol esters of carboxylic acids, di(2-ethylhexyl) secacate, di(2-ethylhexyl) adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis(p-phenoxy phenyl) ether, phenoxy phenylethers, dialkylbenzenes, etc.

As hereinbefore indicated, the aforementioned additives can be incorporated as additives in grease compositions. When high temperature stability is not a requirement of the finished grease, mineral oils having a viscosity of at least 40 SSU at 150° F. are useful. Otherwise those falling within the range of from about 60 SSU to about 6,000 SSU at 100° F. may be employed. The lubricating compositions of the improved greases of the present invention, containing the above-described additives, are combined with a grease forming quantity of a thickening agent. For this purpose, a wide variety of materials can be dispersed in the lubricating oil in grease-forming qualities in such degree as to impart to the resulting grease composition the desired consistency. Exemplary of the thickening agents that may be employed in the grease formulation are metal soaps as well as non-soap thickeners, such as surface-modified clays and silicas, aryl ureas, calcium complexes and similar materials. In general, grease thickeners are employed which do not melt or dissolve when used at the required temperature within a particular environment; however, in all other respects, any material which is normally employed for thickening or gelling oleaginous fluids or forming greases may be used in the present invention.

Generally the lubricants of the present invention contain an amount of the sulfurized product effective to improve extreme pressure properties and antiwear and oxidation characteristics. Normally this amount will be about 0.01–20%, preferably about 0.01–10%, of the total weight of the lubricant.

The invention also contemplates the use of other additives in combination with the sulfurized olefin product. Such additives include, for example, detergents and dispersants of the ash-producing or ashless type, corrosion-inhibiting agents, auxiliary oxidation-inhibiting agents, pour point depression agents, auxiliary extreme pressure agents, color stabilizers and anti-foam agents.

The following examples serve to illustrate the present invention, but are not intended as limitations thereon unless otherwise stated.

EXAMPLE 1

Isobutylene was sulfurized according to the method of U.S. Pat. No. 3,703,504 which is incorporated herein by reference. Olefins sulfurized by the process disclosed in this patent represent a more difficult and more expensive method of preparing sulfurized olefins which do not impart undesired properties to a lubricant composition.

EXAMPLE 2

Isobutylene was sulfurized by the following procedure. This represents the preferred method of making the sulfurized olefins used in making the additive of this invention because the process is simple and more economical. A two-liter stirred autoclave was charged with 320 grams (10 moles) of sulfur. The reactor was sealed and pressurized with nitrogen and vented twice to remove oxygen from the system. The reactor was charged with 280 grams (5 moles) of liquid isobutylene.

The reactor temperature was raised to 160° C. and maintained at that temperature until the pressure dropped from its maximum of 670 psi, to less than 60 psi. The reactor was cooled to 100° C. and vented to a caustic scrubber. The product obtained was then sparged with nitrogen for three hours at 100° C.

The product was then cooled to 25° C. and filtered through Whatman No. 3 paper with a mat of Hyflow Super-cel. Yield was typically greater than 97%, of which 52.6% was sulfur.

EXAMPLE 3

Glycerol Monooleate Adduct

To 500 grams of the product of Example 2 was added 50 grams of glycerol monooleate. This mixture was reacted at 100° C. for four hours under a nitrogen flow. This product was found to contain 46.4% sulfur.

In a like manner, the following examples were prepared.

| Example # | Wt (grams) Example 2 | Wt (grams) Glycerol Monooleate | % S |
|---|---|---|---|
| 4 | 500 | 75 | 46.6 |
| 5 | 500 | 25 | 51.4 |
| 6 | 500 | 15 | 51.9 |
| 7 | 500 | 38 | 55.6 |

EXAMPLE 8

Evaluation of Products

Each of the products of Examples 1, 2 and 3 was blended at 1.38 weight percent in SAE 90 mineral oil and evaluated in the LFW-1 friction test, which measures coefficient of friction under variable load and speed conditions, and which gives a measurable wear scar on the test specimen. Frictional properties on both steel-on-steel and steel-on-bronze test specimens are recorded below.

| Coefficient of Friction Additive in SAE 90 Mineral Oil | | | | | | | | |
|---|---|---|---|---|---|---|---|---|
| Load | | | Steel on Steel | | | Steel on Bronze | | |
| lbs | RPM | m/sec | Ex 1 | Ex 2 | Ex 3 | Ex 1 | Ex 2 | Ex 3 |
| 2 | 164 | 0.30 | .105 | .133 | .107 | .125 | .118 | .128 |
| | 109 | 0.20 | .103 | .130 | .105 | .127 | .117 | .130 |
| | 54.6 | 0.10 | .108 | .130 | .105 | .127 | .117 | .130 |
| | 27.3 | 0.05 | .110 | .137 | .105 | .127 | .117 | .130 |
| | 13.7 | 0.025 | .115 | .150 | .105 | .127 | .117 | .130 |
| | 6.9 | 0.0125 | .120 | .157 | .105 | .127 | .117. | .130 |
| | Max | 0.36 | .093 | .115 | .100 | .133 | .127 | .127 |
| | 164 | 0.30 | .090 | .108 | .100 | .125 | .118 | .123 |
| 4 | 164 | 0.30 | .107 | .120 | .102 | .119 | .123 | .118 |
| | 109 | 0.20 | .102 | .115 | .101 | .119 | .114 | .119 |
| | 54.6 | 0.10 | .105 | .117 | .103 | .119 | .115 | .119 |
| | 27.3 | 0.05 | .109 | .125 | .103 | .120 | .116 | .118 |
| | 13.7 | 0.025 | .113 | .133 | .104 | .120 | .117 | .119 |

-continued

| Load lbs | RPM | m/sec | Coefficient of Friction Additive in SAE 90 Mineral Oil: Steel on Steel Ex 1 | Steel on Steel Ex 2 | Steel on Steel Ex 3 | Steel on Bronze Ex 1 | Steel on Bronze Ex 2 | Steel on Bronze Ex 3 |
|---|---|---|---|---|---|---|---|---|
| | 6.9 | 0.0125 | .119 | .147 | .106 | .120 | .117 | .119 |
| | Max | 0.36 | .100 | .103 | .099 | .118 | .118 | .116 |
| | 164 | 0.30 | .098 | .107 | .100 | .117 | .119 | .116 |
| 6 | 164 | 0.30 | .098 | .109 | .098 | | | |
| | 109 | 0.20 | .094 | .106 | .100 | | | |
| | 54.6 | 0.10 | .096 | .113 | .101 | | | |
| | 27.3 | 0.05 | .102 | .123 | .101 | | | |
| | 13.7 | 0.025 | .108 | .128 | .104 | | | |
| | 6.9 | 0.0125 | .118 | .137 | .105 | | | |
| | Max | 0.36 | .089 | .094 | .095 | | | |
| | 164 | 0.30 | .087 | .093 | .096 | | | |
| Ave. Scar Width (mm) | | | 1.26 | 1.61 | 1.30 | 3.37 | 3.85 | 4.52 |

The relatively low coefficient of friction of Example 1 is desirable for certain applications. Example 2 is a more active EP additive than Example 1 and is much lower in cost, but its high coefficient of friction makes it unacceptable for certain applications. The results for Example 3 demonstrate the improvement in frictional properties achievable by reaction of Example 2 with glycerol monooleate.

EXAMPLE 9

Further Evaluation of Product

A second evaluation was carried out using oil blends equivalent to fully formulated gear oil packages at the GL-5 treating level. The packages containing Example 1 and Example 3 both have low coefficients of friction, while the package containing Example 2 has a high coefficient of friction in this test. If glycerol monooleate is blended into the Example 2 package, no lowering of the coefficient of friction is observed. Thus, it is the reaction product of Example 2 with glycerol monooleate and not glycerol monooleate itself which brings about the improved frictional properties.

| Arm Load lbs | RPM | m/sec | Oil Blend of Package Containing Additive Steel on Steel: Ex 1 | Ex 2 | Ex 3 | Ex 2 + Glycerol Monooleate |
|---|---|---|---|---|---|---|
| 2 | 164 | 0.30 | .115 | .133 | .117 | .125 |
| | 109 | 0.20 | .115 | .132 | .117 | .122 |
| | 54.6 | 0.10 | .115 | .132 | .117 | .122 |
| | 27.3 | 0.05 | .115 | .132 | .117 | .122 |
| | 13.7 | 0.025 | .115 | .132 | .117 | .123 |
| | 6.9 | 0.0125 | .115 | .137 | .117 | .127 |
| | Max | 0.36 | .107 | .117 | .107 | .115 |
| | 164 | 0.30 | .105 | .105 | .105 | .113 |
| 4 | 164 | 0.30 | .080 | .101 | .084 | .108 |
| | 109 | 0.20 | .078 | .100 | .083 | .107 |
| | 54.6 | 0.10 | .078 | .103 | .083 | .107 |
| | 27.3 | 0.05 | .079 | .105 | .085 | .109 |
| | 13.7 | 0.025 | .080 | .110 | .087 | .111 |
| | 6.9 | 0.0125 | .081 | .110 | .090 | .117 |
| | Max | 0.36 | .075 | .093 | .079 | .103 |
| | 164 | 0.30 | .074 | .093 | .079 | .101 |
| 6 | 164 | 0.30 | .064 | .088 | .073 | .103 |
| | 109 | 0.20 | .063 | .086 | .073 | .104 |
| | 54.6 | 0.20 | .063 | .088 | .074 | .104 |
| | 27.3 | 0.05 | .065 | .092 | .076 | .107 |
| | 13.7 | 0.025 | .067 | .096 | .082 | .109 |
| | 6.9 | 0.0125 | .070 | .101 | .083 | .112 |
| | Max | 0.36 | .057 | .074 | .067 | .096 |
| | 164 | 0.30 | .057 | .075 | .066 | .094 |
| Ave. Scar Width (mm) | | | 1.025 | 1.394 | 1.163 | 1.20 |

The products were evaluated in the Four-Ball Wear Test at the indicated concentration in a mineral oil base stock. Conditions were 60 kg load, 30 minutes, ½ inch 52100 steel balls. The data in the table below demonstrates the improved wear protection imparted to lubricating oils by the products herein described. Reaction of the product of Example 2 with glycerol monooleate produces products superior in antiwear properties when compared with either Example 1 or Example 2.

| | Wt % S in Oil | Wear Scar, mm: 1000 rpm 200° F. | 1000 rpm 300° F. | 2000 rpm 200° F. | 2000 rpm 300° F. |
|---|---|---|---|---|---|
| Base Stock | 0 | 0.905 | 1.229 | 3.988 | 2.390 |
| + 1.5% Ex. 1 | 0.698 | 0.7083 | 1.013 | 1.292 | 1.258 |
| + 1.0% Ex. 2 | 0.520 | 0.750 | 1.150 | 1.333 | 1.354 |
| + 1.5% Ex. 2 | 0.780 | 1.217 | 1.246 | 1.642 | 1.980 |
| + 1.5% Ex. 3 | 0.696 | 0.704 | 0.692 | 1.154 | 1.417 |
| + 1.5% Ex. 4 | 0 699 | 0.617 | 0.629 | 0.996 | 1.375 |
| + 1.5% Ex. 5 | 0.771 | 0.675 | 0.871 | 1.350 | 1.492 |
| + 1.5% Ex. 6 | 0.779 | 0.717 | 1.363 | 1.604 | 1.873 |
| + 1.5% Ex. 7 | 0.834 | 0.625 | 0.688 | 1.468 | 1.533 |

What is claimed:

1. A lubricating oil composition comprising a major proportion of a hydrocarbon lubricating oil or grease prepared therefrom and between 0.01 and 20 percent by weight of an additive which is the reaction product of a sulfurized olefin with glycerol monooleate.

2. The composition of claim 1 wherein the sulfurized olefin is prepared by reacting free or elemental sulfur directly with an olefin.

3. The composition of claim 1 wherein said sulfurized olefin contains from 3 to 8 carbon atoms per molecule and has a content of combined sulfur in excess of about 45% by weight.

4. The composition of claim 1 wherein said sulfurized olefin comprises at least a major proportion of sulfurized isobutylene, and the final sulfurized olefin product has a content of combined sulfur in excess of 45% by weight.

5. The composition of claim 2 wherein the molar ratio of said sulfur to said olefin is between about 1.7:1 and 2.3:1.

6. The composition of claim 2 wherein the molar ratio of said sulfur to said olefin is between about 1.9:1 and 2.1:1.

7. The composition of claim 2 wherein the free or elemental sulfur is reacted with the olefin at a temperature between about 140° C. and 180° C. and the resulting sulfurized olefin is reacted with glycerol monooleate at a temperature between about 70° C. and about 120° C.

8. The composition of claim 7 wherein said sulfurized olefin contains from 3 to 8 carbon atoms per molecule and the molar ratio of said sulfur to said olefin is between about 1.7:1 and 2.3:1.

9. The composition of claim 1 wherein said glycerol monooleate contains glycerol dioleate.

10. The composition of claim 1 wherein said lubricating oil is selected from (1) mineral oils (2) synthetic oils (3) mixtures of mineral and synthetic oils or (4) a grease prepared from any one of (I), (2) or (3).

11. The composition of claim 10 wherein said oil is (1) a mineral oil.

12. The composition of claim 10 wherein said oil is (2) a synthetic oil.

13. The composition of claim 10 wherein said oil is (3) a mixture of mineral and synthetic oils.

14. The composition of claim 1 wherein said composition is a grease.

* * * * *